United States Patent [19]

Gonzalez

[11] Patent Number: 5,019,352

[45] Date of Patent: May 28, 1991

[54] SCENTED AIR FILTER FOR USE WITH A FORCED AIR CENTRAL HEATING AND COOLING SYSTEM

[76] Inventor: Jose Gonzalez, 1913 Lantana Ct., Virginia Beach, Va. 23456

[21] Appl. No.: 570,440

[22] Filed: Aug. 21, 1990

[51] Int. Cl.[5] ..... A62B 7/08

[52] U.S. Cl. ..... 422/123; 55/279; 422/4

[58] Field of Search ..... 55/164, 233, 279, 227; 422/4, 5, 36, 171, 172, 173, 177, 123, 124

[56] References Cited

U.S. PATENT DOCUMENTS 2,469,656 5/1949 Lienert ..... 422/4 X 4,339,079 7/1982 Sato et al. ..... 422/123 X

*Primary Examiner*—Charles Hart

*Attorney, Agent, or Firm*—Terry M. Gernstein

[57] ABSTRACT

A filter element for use with a forced air central heating and cooling system includes a liquid reservoir that is fluidically connected to a plurality of wick elements that are located in the filter media of the filter element. A movable plate includes wick portions and portions that are impervious to fluid, and is moved from a position fully connecting the wick elements to the fluid in the fluid reservoir to a position preventing such fluid connection to control the amount of scent placed into the system.

6 Claims, 3 Drawing Sheets

SCENTED AIR FILTER FOR USE WITH A FORCED AIR CENTRAL HEATING AND COOLING SYSTEM

TECHNICAL FIELD OF THE INVENTION

The present invention relates to the general art of fluid contact systems, and to the particular field of air filters.

BACKGROUND OF THE INVENTION

Many homes, offices, apartments, and the like are heated and cooled by a forced air system. These systems generally include a central heating and cooling unit, such as a heat pump, duct work, registers and control units. These systems further include a filter, and air is circulated through such filter prior to entering the central heating and cooling unit for conditioning. The filtered and conditioned air is then sent to the various zones associated with the system.

As many are aware, homes, offices and the like are often subject to having odors permeate therethrough. These odors can be pleasant, such as cooking odors, or can be unpleasant, such as musty odors, or tobacco odors, or the like. Because there are certain odors which are unpleasant or are unwanted, the art contains numerous devices for eliminating such unwanted odors. These devices range from simple perfumes that are dispensed from a hand-held container to sophisticated ion exchange devices.

While such devices often work satisfactorily, they all have a common shortcoming in that they are quite localized. That is, these devices are room oriented and are effective in only small, local areas of an overall environment. Accordingly, if an entire environment is to be treated, several such devices will be required, one for each portion of the overall area.

These localized conditioners can be acceptable in some instances, but need to be replaced on a periodic basis and tend to produce zones that are more intensely treated than adjacent zones. Thus, for example, a kitchen may container a higher concentration of room deodorizer than an adjacent dinning room. In fact, these devices are so localized that there may be concentration gradients even within the same room. This may be wasteful and produce a noticeable change in scent within a room. The concept behind many of these devices is to produce a pleasant odor which becomes unnoticed except for a pleasant sensation. Unbalanced concentrations within a room defeats such object.

Since the central heating and cooling system can force air into all rooms and areas of a dwelling in equal or controlled amounts, the central heating and cooling system may be a good choice to distribute pleasant scents or germicidal gases throughout a dwelling.

Accordingly, there are several suggestions in the art for combining aromatic scent dispersing means with filters and the like that are used in a central forced air heating and cooling system. See, for example, the devices disclosed in U.S. Pat. Nos. 4,065,262, 4,563,333 and 4,604,114.

While effective in most situations, devices such as the above-mentioned patented devices, still have several drawbacks. For example, such devices, while used in conjunction with a filter for a central forced air system, still are quite localized within such filter, and thus may still produce concentration gradients. Still further, there is no sure way of determining when to replace such devices, and the entire device must be replaced if the scent is to be changed or if the scent of the device is exhausted. The amount of scent ingested into the air stream from such devices is also not totally controllable so that at certain times, such as at night, the same amount of scent is placed in the dwelling as at other times, such as during the day during cooking or at other high activity times. This is wasteful and may even be annoying as the amount of scent necessary to overcome high usage times may be overbearing at low use times.

Accordingly, there is a need for a means to supply a pleasing scent to an overall environment in a controllable, replenishable manner that will distribute scent in selected areas in an even, controlled manner.

OBJECTS OF THE INVENTION

It is a main object to provide a means to supply a pleasing scent to an overall environment in a controllable, replenishable manner that will distribute scent in selected areas in an even, controlled manner.

It is another object to provide a means to supply a pleasing scent to an overall environment in a controllable, replenishable manner that will distribute scent in selected areas in an even, controlled manner using a central heating and cooling forced air system.

It is another object to provide a means to supply a pleasing scent to an overall environment in a controllable, replenishable manner that will distribute scent in selected areas in an even, controlled manner which includes means for replenishing the scented fluid.

It is a specific object of the present invention to provide a filter for use with a forced air central heating and cooling system which will dispense controlled amounts of scented fluid to be transferred to air moving through such central heating and cooling system.

SUMMARY OF THE INVENTION

These, and other, objects are achieved by providing a filter element for use with a forced air central heating and cooling system which filter element includes a controllable mass transfer system. The mass transfer system uses a wick element positioned in the filter media and having a base that is in fluid connection with a reservoir. A plate is movably mounted on the filter element and includes porous media thereon that fluidically connects the wick base elements to a reservoir of scented liquid. Movement of the plate covers or uncovers selected amounts of the wick base and thus controls the amount of scented fluid being dispensed by the wick into the air stream passing through the filter element. The filter element is inserted into the forced air system in the manner of the usual filter so that air passes through the filter element prior to being transferred to the various zones of the system.

The wick material is selected to co-operate with the particular filter media and the state and flow conditions of the air flowing through the filter to transfer selected amounts of scent-producing liquid from the reservoir to the air flowing through the filter element.

BRIEF DESCRIPTION OF THE DRAWING FIGURES

DETAILED DESCRIPTION OF THE PREFERRED EMBODIMENT OF THE INVENTION

Figure 1:
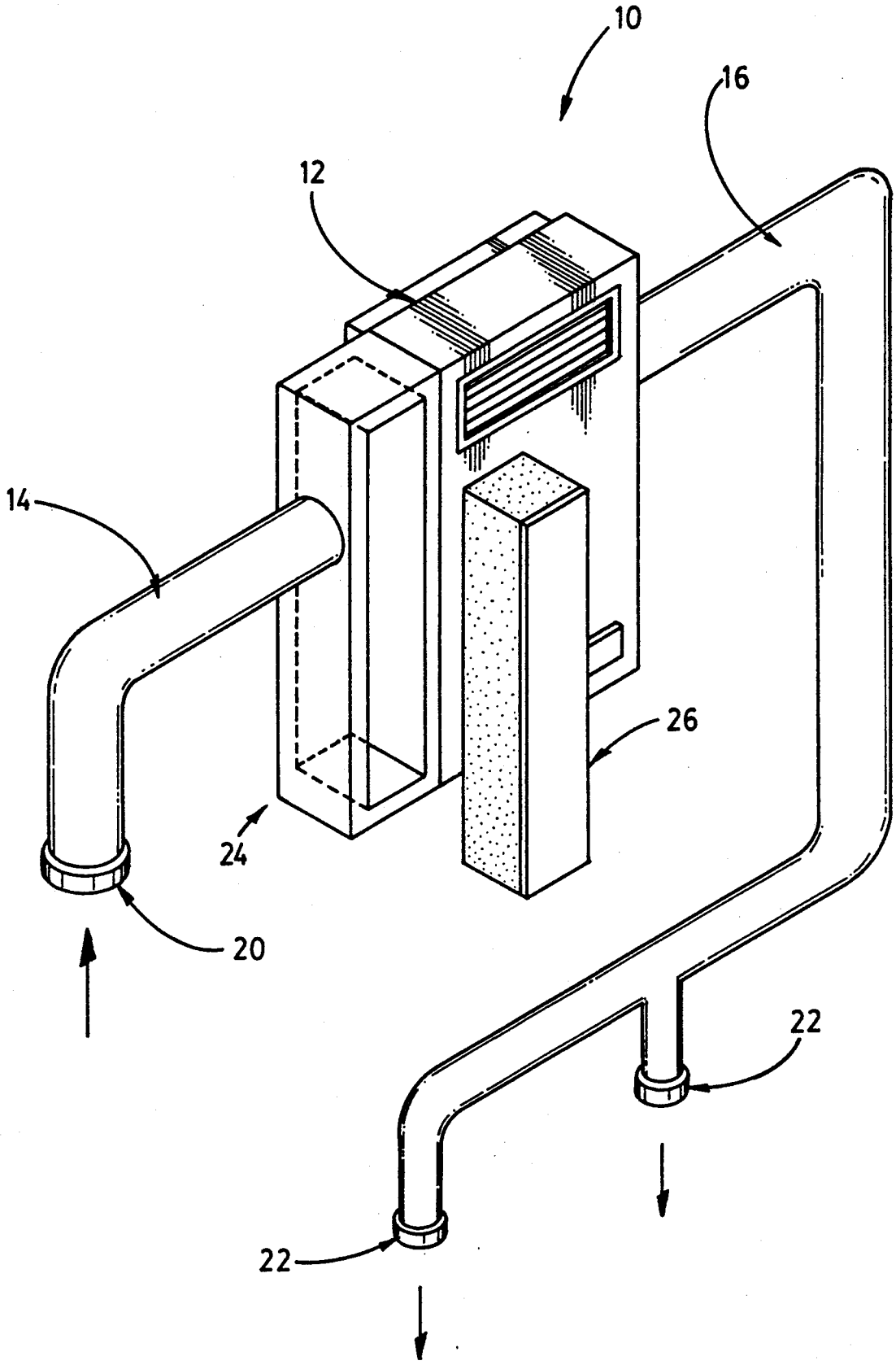
FIG. 1 is a perspective schematic of a forced air central heating and cooling system having a scent-producing filter element embodying the present invention.

Shown in FIG. 1 is a forced air central heating and cooling system 10 for use in controlling the environment of a dwelling such as a home, office, or the like. The system 10 includes a central unit, such as heat pump 12 that heats and/or cools the air being moved through the system by appropriate fans and the like that are common to such systems. Ducts, such as intake duct 14 and return duct 16 conduct air to the central unit 12 and to the various zones of the dwelling as indicated by the arrows I and R, with air moving through appropriate grille works, such as inlet grille 20 and return grille 22.

The system 10 also includes a filter unit 24 that houses a filter element 26 between the duct 14 and the central unit 12. The filter element 26 is removably mounted in the housing and includes a mass transfer system for ingesting controllable amounts of scent-producing liquid into the filter in a manner that causes that liquid to diffuse into the air passing through the filter in the system 10.

Figure 2:
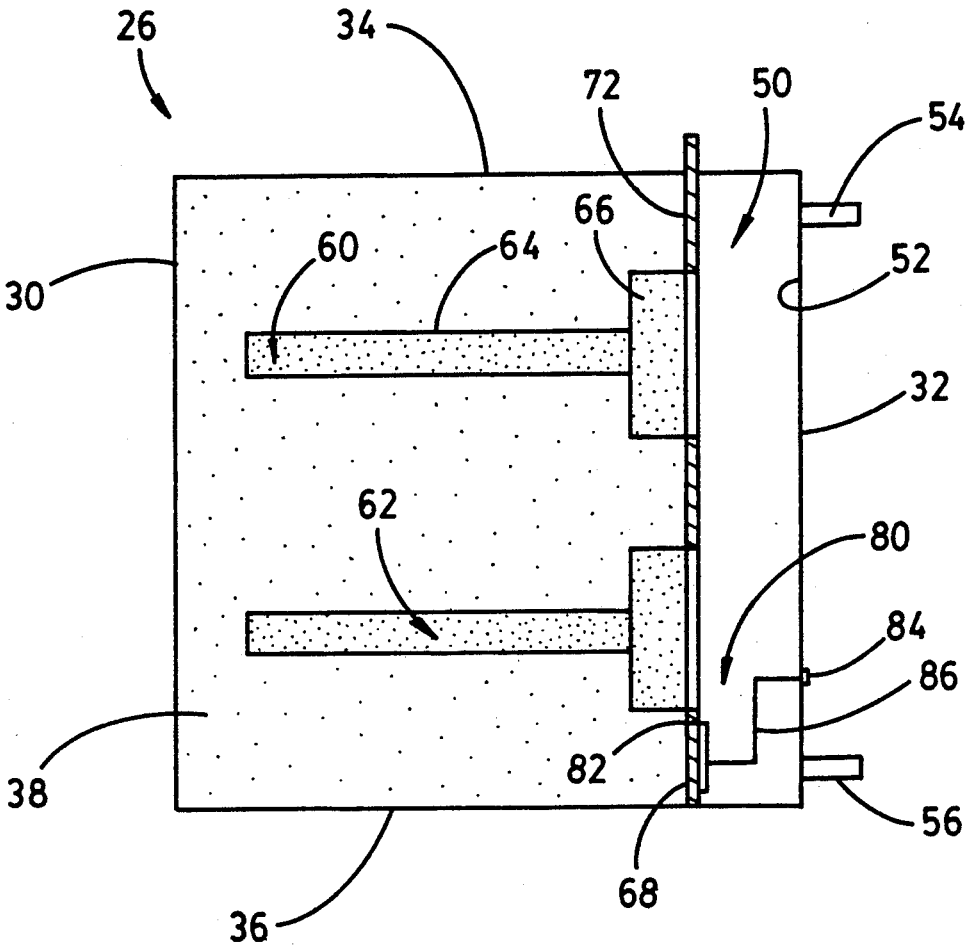
FIG. 2 is a plan view of the scent-producing filter element of the present invention showing wick elements in full fluid connection with a reservoir of scent-producing liquid.
Figure 3:
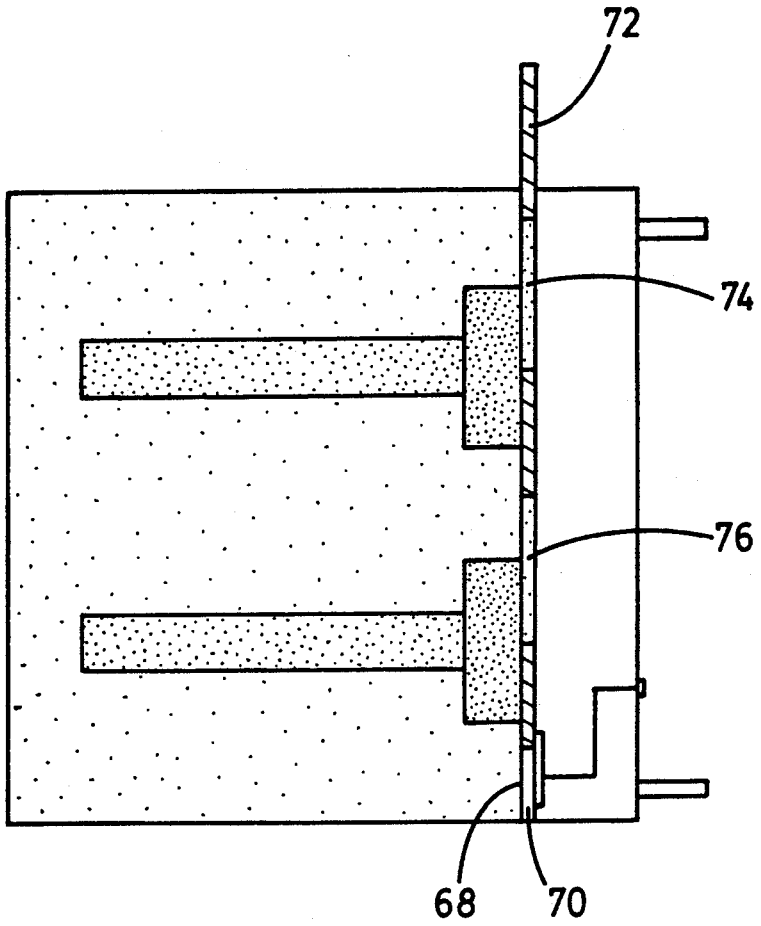
FIG. 3 shows the scent-producing filter element of the present invention with the wick elements thereof in partial fluid connection with the reservoir of scent-producing liquid.

The filter element 26 is best shown in FIGS. 2 and 3, and attention is now adverted to such figures. The filter element 26 includes a frame having sides 30 and 32 and ends 34 and 36, and houses the usual filter media 38, such as fiberglass or the like. The filter element can also include the usual structural reenforcement elements which are not shown since such elements form no part of the present invention, and those skilled in the art will understand what type of elements will be needed based on the teaching of the present disclosure.

The filter element 26 further includes a mass transfer system which includes a fluid reservoir 50 located within the perimeter of the frame and is designed to contain scented liquid, such as disclosed in patents such as patents such as U.S. Pat. No. 4,065,262, and such disclosure is incorporated herein by reference. The fluid reservoir 50 includes fluid impermeable walls, such as wall 52, an inlet conduit 54 and a drain 56 for containing fluid without permitting such fluid to contact the filter media. A simple plastic container can be used for the fluid reservoir 50 if desired.

The mass transfer system further includes a plurality of wick elements, such as wick elements 60 and 62 that include elongated portions, such as portion 64 and base portions, such as base portion 66 of wick element 60. The base portions are fixed to a wall 68 that is fixed with respect to the sides and ends of the filter element and which is spaced from the wall 52 of the reservoir. The wall 68 is hollow and defines a chamber 70 therein which slidably receives a movable plate 72. The plate 72 is formed of plastics-type material and includes a plurality of porous sections, such as sections 74 and 76. The porous sections 74 and 76 are preferably formed of wick material and are sized to correspond to the cross-sectional area of the wick element bases 66 to fluidically connect such wick element bases with the fluid in the reservoir 50. The other areas of the plate are impervious to the liquid in the reservoir 50.

The plate is movable from a fully-inserted position shown in FIG. 2 to fluidically connect the wicks to the reservoir, to a partially withdrawn position shown in FIG. 3 to interpose the fluid impervious portions of the plate between the wick bases and the fluid reservoir thereby preventing fluid or mass transfer from the fluid reservoir to the wicks. As the plate is withdrawn, less area of the porous sections 76 connects the bases 66 to the fluid in the reservoir and thus less of the fluid in that reservoir will flow to the wick elements. The plate 72 is impervious to the liquid in the reservoir, and thus can be used to control the amount of liquid flowing to the wick elements. The plate can be fully inserted into the FIG. 2 position during a period of high occupancy and when the maximum amount of scented air is desired, and can be withdrawn partially as shown in FIG. 3, or fully withdrawn to completely stop the transfer of liquid from the reservoir to the porous filter media via the wick elements in periods of low use or low occupancy, such as at night or the like.

The mass transfer system further includes a signal 80 to signal that fluid in the reservoir 50 is low and needs replenishing. Such a system is similar to those used in automobile fuel tanks to measure the amount of fuel remaining, and includes a sensor plate 82 located in the reservoir, a signal element, such as a light 84 located on the frame in a visible location, and a lead 86 connecting the sensor plate to the light. Suitable power means (not shown), such as batteries or the like are also included in the system. The signal element 84 can be visible or can include an audible alarm as well.

The mass transfer system of the present invention uses a wick process to control the amount of fluid being transferred from the reservoir to the air passing through the filter element. The wick materials are selected to co-operate with the state and flow conditions existing in the air flowing through the filter media to transfer the desired amount of mass to that air. The materials used in the wick elements are selected according to the constraints and considerations discussed below. Using such constraints and considerations in conjunction with his knowledge, one skilled in the art will be able to select the wick materials most suitable for the particular application of interest. Accordingly, only the guidance and parameters as well as the proper text material will be presented herein so the skilled artisan will be able to select the materials based on the teaching of this disclosure.

Mass transfer, like heat transfer, is basically a diffusional process where material, instead of heat, diffuses into a flowing medium while it contacts an available source. The basic mass-diffusion process is analogous to the heat-transfer process in that a flux is established in order to equalize the spatial distribution of a property, as expressed by its gradient. The mass flux has been shown to be proportional to the mass fraction gradient, and in simplified, or specialized applications, diffusive fluxes can be related to driving potentials in terms of concentrations or partial pressure gradients.

Thus, to calculate mass transfer rates, a potential relationship can be used:

$$\dot{m}=gB$$

where $\dot{m}$ = the mass transfer rate;

g = the mass transfer conductance; and

B = the mass transfer driving force, or potential differences.

The various factors in the mass transfer relationship can be derived from various theories, such as wicking theory, evaporation theory, wet-bulb psychometer theory, and the like based on the teaching and disclosures of references such as "Principles of Heat Transfer" by Frank Kreith, published by the International Textbook Company in 1962, especially chapter 13; "Convective Heat and Mass Transfer" by W. M. Kays, published by McGraw-Hill in 1966, especially chapters 14–16; and "Advances in Heat Transfer" volume 1, edited by T. F. Irvine, Jr. and J. P. Hartnett and published by Academic Press in 1964, especially pages 123–184; with the just-mentioned disclosures being fully incorporated herein by reference.

It is understood that while certain forms of the present invention have been illustrated and described herein, it is not to be limited to the specific forms or arrangements of parts described and shown.

I claim:

1. An air filter for use in conjunction with a forced air central heating and cooling system, which comprises:

(A) a frame element which is sized to be removably mounted between an intake duct and a heating and cooling unit of a forced air central heating and cooling system;

(B) a porous filter media mounted on said frame element to be fluidically interposed between the intake duct and the heating and cooling unit; and (C) a mass transfer system mounted on said frame element and including (1) a fluid reservior extending along one side of said frame element and having a fluid inlet and a fluid drain and containing liquid mass therein, (2) wick elements connected to said fluid reservoir and extending across said frame element and being in mass transferring contact with said filter media, said wick elements each including a base portion and an elongated body portion which has a mass transfer coefficient that causes mass from said reservoir to be transferred to air flowing through said filter media, and (3) a plate movably mounted on said frame element to be interposed between said wick base portions and said reservoir, said plate including wick media and blocking media that is impermeable to the liquid contained in said reservoir, and being movable from a position placing said plate wick media in position to fluidically connect said wick element base portions to said reservoir to a position placing said blocking media between said wick element base portions and said fluid reservoir.

2. The air filter defined in claim 1 wherein the heating and cooling unit includes a heat pump.

3. The air filter defined in claim 2 further including a frame support on said heat pump.

4. The air filter defined in claim 3 wherein said frame support includes means for removably mounting said frame element.

5. The air filter defined in claim 4 further including a liquid level sensing means in said reservoir.

6. The air filter defined in claim 5 wherein said liquid level sensing means includes a signal means.

* * * * *